US010170033B2

(12) United States Patent
Yoo et al.

(10) Patent No.: US 10,170,033 B2
(45) Date of Patent: Jan. 1, 2019

(54) DISPLAY DEVICE

(71) Applicant: SAMSUNG ELECTRONICS CO., LTD., Suwon-si, Gyeonggi-do (KR)

(72) Inventors: Kwi Sung Yoo, Yongin-si (KR); Dong Hoon Baek, Seoul (KR); Dong Myung Lee, Hwaseong-si (KR); Hyun Wook Lim, Seoul (KR); Eun Young Jin, Hwaseong-si (KR); Jae Youl Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 108 days.

(21) Appl. No.: 15/358,906

(22) Filed: Nov. 22, 2016

(65) Prior Publication Data

US 2017/0148377 A1 May 25, 2017

(30) Foreign Application Priority Data

Nov. 24, 2015 (KR) ..... 10-2015-0164849

(51) Int. Cl.
*G09G 3/20* (2006.01)

(52) U.S. Cl.
CPC ..... *G09G 3/2096* (2013.01); *G09G 3/2092* (2013.01); *G09G 2310/0221* (2013.01); *G09G 2370/08* (2013.01); *G09G 2370/10* (2013.01)

(58) Field of Classification Search
None
See application file for complete search history.

(56) References Cited

U.S. PATENT DOCUMENTS

| | | | | |
|---|---|---|---|---|
| 5,576,765 | A * | 11/1996 | Cheney | 345/407 |
| 6,859,500 | B2 | 2/2005 | Frojdh et al. | |
| 7,385,533 | B2 | 6/2008 | Sawada et al. | |
| 7,714,749 | B2 | 5/2010 | Feller | |
| 7,804,428 | B2 | 9/2010 | Oslick | |
| 8,396,306 | B2 | 3/2013 | Niemi et al. | |
| 8,731,066 | B2 | 5/2014 | Sprljan et al. | |
| 8,848,789 | B2 | 9/2014 | Bao | |
| 2014/0253535 | A1 | 9/2014 | Lim et al. | |
| 2014/0359394 | A1 | 12/2014 | Gasanov et al. | |
| 2015/0121164 | A1 | 4/2015 | Kamali et al. | |

* cited by examiner

*Primary Examiner* — Nicholas R Wilson
(74) *Attorney, Agent, or Firm* — F. Chau & Associates, LLC

(57) ABSTRACT

A display device includes a data generator configured to generate a clock-embedded data packet, and a controller configured to control operation of the data generator. The data packet comprises a header, a first symbol comprising address information therein, and a second symbol not comprising address information, and the header comprises address information of the first symbol.

18 Claims, 12 Drawing Sheets

DISPLAY DEVICE

This application claims priority under 35 U.S.C. § 119 from, and the benefit of, Korean Patent Application No. 10-2015-0164849 filed on Nov. 24, 2015 in the Korean Intellectual Property Office, the contents of which are herein incorporated by reference in their entirety.

BACKGROUND

1. Technical Field

Embodiments of the present disclosure are directed to to a display device.

2. Discussion of the Related Art

A display device is a semiconductor device that may include a signal controller, a gate driver, a data driver and a display panel. The signal controller provides a gate control signal to the gate driver and provides an image data signal and a data control signal to the data driver. Each of the gate driver and the data driver may include a plurality of driving chips. The gate driving chips provide gate signals to gate lines, and the data driving chips provide image data voltages corresponding to image data signals to data lines.

As recent display devices exhibit high resolution and reproduce deep colors, an interface is required that can stably and efficiently transmit image data signals and data control signals between the signal controller and the data driving chips.

Specifically, intra-panel interface environment increasingly use a clock-embedded signal for transmitting high speed data with no clock line, as well as clock data recovery (CDR) for recovering the clock and data.

To perform the CDR efficiently, the run length, during which data is constantly maintained with no data toggle, should be reduced. To this end, redundant bits may be inserted into data. However, this increases data processing overhead.

SUMMARY

Embodiments of the present disclosure can provide a display driving device for encoding a data packet that reduces the maximum run length and overhead in data processing.

Embodiments of the present disclosure can provide a display driving device for decoding a data packet that reduces the maximum run length and overhead in data processing.

According to some embodiments of the present inventive concept, there is provided a display device that includes a data generator configured to generate a clock-embedded data packet, and a controller configured to control operation of the data generator. The data packet comprises a header, a first symbol that includes address information therein, and a second symbol that does not include address information. The header comprises address information of the first symbol.

According to some embodiments of the present inventive concept, there is provided a display device that includes a data recoveror configured to receive a clock-embedded data packet to recover data therefrom, and a controller configured to control operation of the data recoveror. The data packet comprises a first symbol that includes address information therein, a second symbol that does not include address information, and a header that includes address information of the first symbol. The data recoveror uses the address information in the header to recover data of the first symbol.

According to some embodiments of the present inventive concept, there is provided a display device that includes a data generator configured to generate a clock-embedded data packet; and a data recoveror configured to receive the clock-embedded data packet to recover data therefrom. The data packet comprises a first symbol that includes address information therein, a second symbol that does not include address information, and a header that includes address information of the first symbol, the data packet comprises $2^{(n-1)}-2$ symbols, and each of the symbols comprises n-bit data, wherein n is a natural number.

DETAILED DESCRIPTION OF EXEMPLARY EMBODIMENTS

Figure 1:
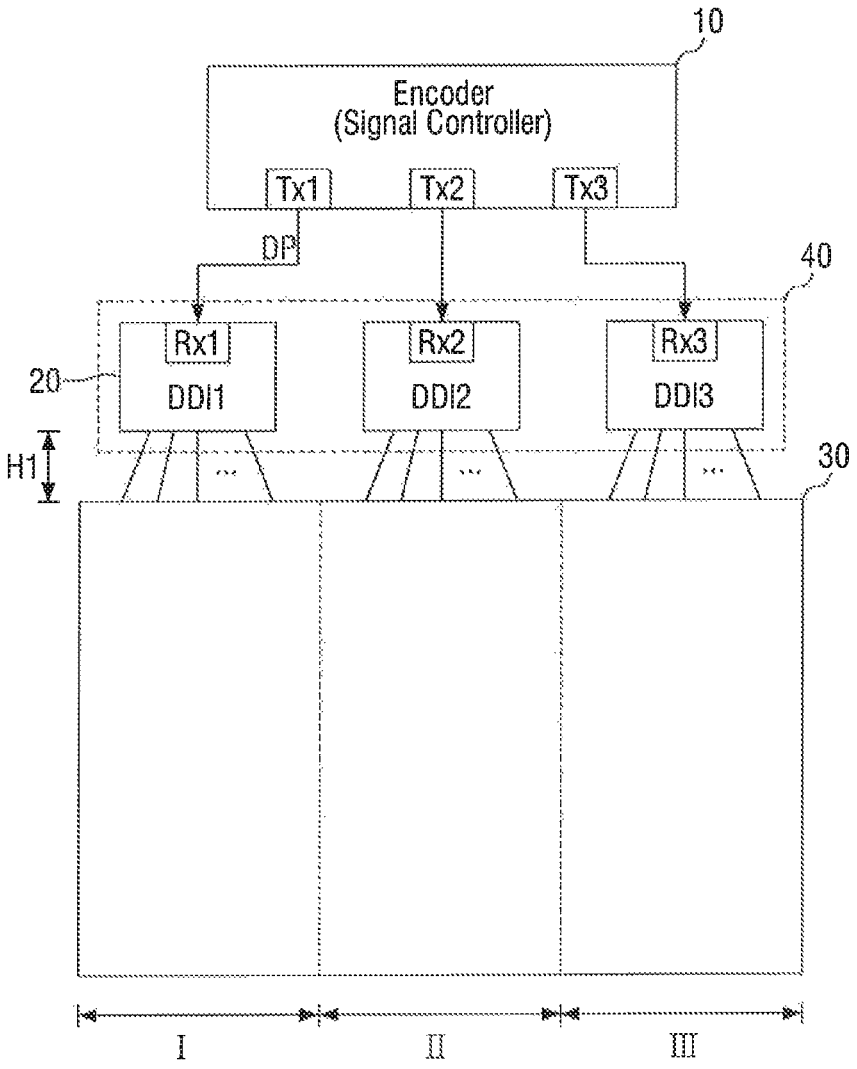
FIG. 1 is a block diagram that illustrates a display device according to some exemplary embodiments of the present disclosure.

The present inventive concept will now be described more fully hereinafter with reference to the accompanying drawings, in which exemplary embodiments of the inventive concept are shown. As is traditional in the field of the inventive concepts, embodiments are described, and illustrated in the drawings, in terms of functional blocks, units and/or modules. Those skilled in the art will appreciate that these blocks, units and/or modules can be physically implemented by electronic (or optical) circuits such as logic circuits, discrete components, microprocessors, hard-wired circuits, memory elements, wiring connections, etc., which can be formed using semiconductor-based fabrication techniques or other manufacturing technologies. Blocks, units and/or modules that are implemented by microprocessors or similar circuits can be programmed using software, such as microcode, to perform various functions discussed herein and may optionally be driven by firmware and/or software. Alternatively, each block, unit and/or module may be implemented by dedicated hardware, or as a combination of dedicated hardware to perform some functions, and a processor, such as one or more programmed microprocessors and associated circuitry, to perform other functions. In addition, each block, unit and/or module of the embodiments may be physically separated into two or more interacting and discrete blocks, units and/or modules without departing from the scope of the inventive concepts. Further, the blocks, units and/or modules of the embodiments can be physically combined into more complex blocks, units and/or modules without departing from the scope of the inventive concepts.

FIG. 1 is a block diagram that illustrates a display device according to some exemplary embodiments of the present disclosure.

Referring to FIG. 1, a display device includes display driving devices 10 and 40, and a display panel 30. The display driving device 10 can be an encoder, and display driving device 40 includes a plurality of decoders 20.

A display device as shown in FIG. 1 may be one of an organic light emitting diode display (OLED), a liquid crystal display (LCD), a plasma display panel (PDP), an electrochromic display (ECD), a digital mirror device (DMD), an actuated mirror device (AMD), a grating light valve (GLV), or an electro luminescent display (ELD), but embodiments are not limited thereto.

According to some embodiments, the display panel 30 is divided into a plurality of areas I, II and III, however, this is for convenience of illustration, and embodiments are not limited thereto. For example, the display panel 30 may be divided into more than three areas, or fewer than three areas.

According to some embodiments, the encoder 10 encodes a data packet DP as described below. For example, the encoder 10 includes a signal controller, and provides each of the plurality of decoders 20 with a data packet DP comprising a data signal having a clock signal embedded therein, namely, a clock-embedded signal.

Although the signal controller shown in FIG. 1 is an example of the encoder 10, this is merely illustrative, and embodiments are not limited thereto. Any known device can be used as the encoder 10 as long as it can encode the data packet DP.

In addition, according to embodiments, the encoder 10 receives raw image signals and external control signals for controlling display of the image signals, and outputs the clock-embedded data packet DP in a data signal.

Specifically, a data signal received by the encoder 10 may include a raw image signal RGB or an image data signal converted from the raw image signal RGB. However, embodiments of the present disclosure are not limited thereto.

According to embodiments, each decoder 20 includes display driving ICs (DDIs). In some embodiments of the present disclosure, the plurality of decoders 20 includes a plurality of display driving circuits. Each display driving circuit can control a respective areas of the display panel 30.

In addition, according to embodiments, the display panel 30 includes a plurality of gate lines, a plurality of data lines, and a plurality of pixels.

Although the display driving circuits are shown as an example of the decoder 20 in FIG. 1, this is merely illustrative, and embodiments are not limited thereto. Any known device can be used as the decoder 20 as long as it can decode the data packet DP.

The decoder 20 includes, for example, a display driving IC (DDI), a source IC, or an LCD driving IC (LDI). The plurality of decoders 20 can separate a data signal from a data packet DP received from the encoder 10. The clock signal embedded in the data packet DP can be used to sample the data packet at appropriate timings to extract a data signal. The extracted data signal is transmitted to the display panel 30.

According to embodiments, a plurality of decoders is used to drive one display panel 30 to reduce the size of the display device. If a single decoder is used to control one display panel, for example, the distance between the decoder and the display panel may be long.

That is, a larger space would be used between the decoder and the display panel to connect the decoder and pixels, or data lines and gate lines connected to the pixels, in the display panel. In contrast, if three decoders DD1 to DD3 are used to control one display panel 30, as shown in the example of FIG. 1, the distance H1 between the decoders DDI1 to DDI3 and the display panel 30 can be reduced.

Figure 2:
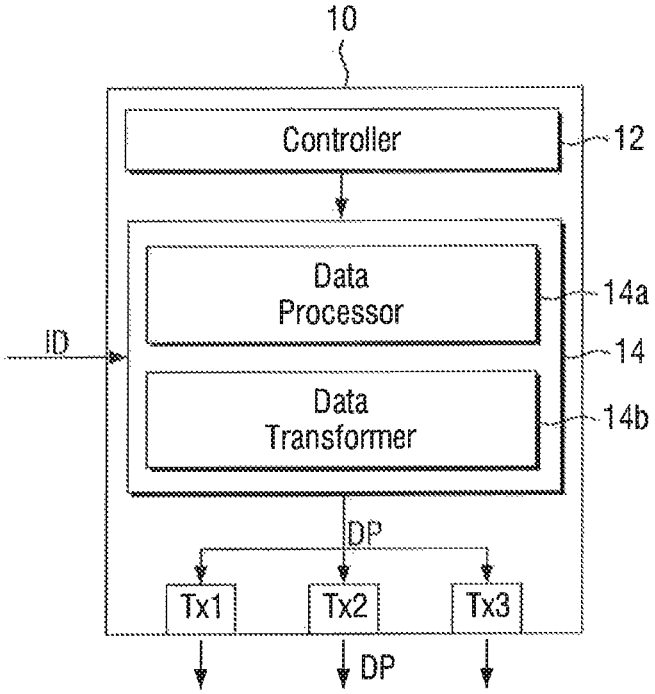
FIG. 2. is a block diagram that illustrates an encoder shown in FIG. 1.
Figure 3:
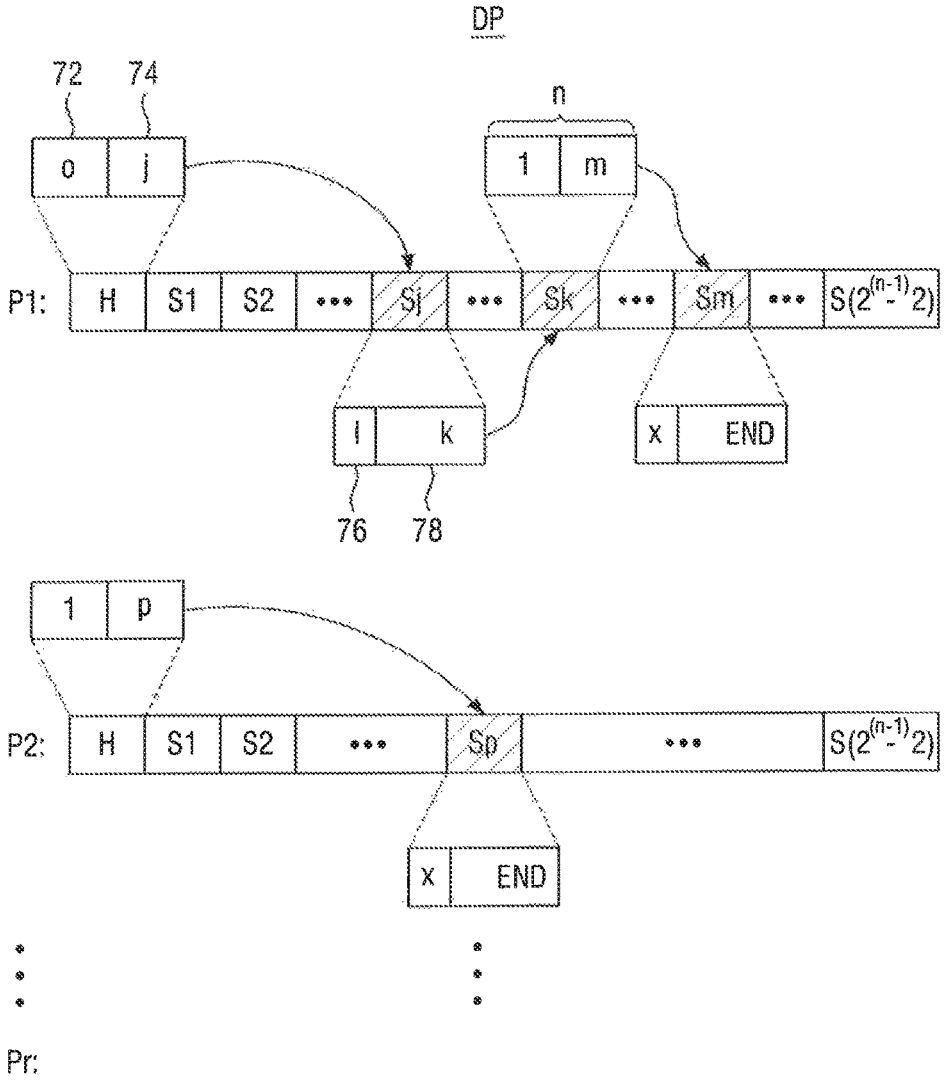
FIG. 3 illustrates a data packet output by an encoder shown in FIG. 1.

FIG. 2 is a block diagram that illustrates an encoder shown in FIG. 1. FIG. 3 illustrates a data packet output by an encoder shown in FIG. 1.

Referring to FIG. 2, according to embodiments, the encoder 10 includes a controller 12, a data generator 14, and transmitters Tx1 to Tx3.

In some embodiments of the present disclosure, the data generator 14 includes a data processor 14*a* and a data transformer 14*b*.

The data processor 14*a* can receive image data ID and can perform a variety of processes, including clock signal embedding. The data transformer 14*b* can transform the image data ID into a data packet DP and output it to the transmitters Tx1 to Tx3.

Although the data processor 14*a* and the data transformer 14*b* are shown as separate elements in FIG. 2 for convenience of illustration, this is merely illustrative, and embodiments are not limited thereto. The data processor 14*a* and the data transformer 14*b* may be either integrated into a single element or further divided into sub-elements, as desired.

Referring to FIG. 3, according to embodiments, the data packet DP generated by the data generator 14 of FIG. 2 includes a plurality of packets P1 to Pr. The packets P1 to Pr can be obtained by dividing the image data ID into a predetermined size.

According to embodiments, each of the packets P1 to Pr includes a header H and a plurality of symbols S1 to $S(2^{(n-1)}-2)$, where n is a natural number that represents the number of bits in each symbol S1 to $(2^{(n-1)}-2)$. For example, if a symbol has three bits, each of the packets P1 to Pr includes a header H and two symbols S1 and S2. For example, if a symbol has four bits, each of the packets P1 to Pr includes a header H and six symbols S1 to S6. It is to be understood that, since there must be at least one symbol S1, a minimum value for n is three.

According to embodiments, each of the packets P1 to Pr includes first symbols comprising address information, indicated by the hatched regions, and second symbols that do not include address information.

For example, a packet P1 may include first symbols Sj, Sk and Sm, and second symbols other than Sj, Sk and Sm.

According to embodiments, each of the first symbols Sj, Sk and Sm includes a data bit 76 and address bits 78. For reasons to be described below with regard to FIGS. 5 and 6, the data bit 76 represents the data of the symbol indicated by address bits 78 of a next first symbol. The address bits 78 represent the address of the next first symbol.

For example, the first symbol Sj may include address bits 78 indicating the address of a next first symbol Sk, and a data bit 76 indicating the data of the first symbol Sk, which is 1 in this example. Similarly, the first symbol Sk includes address bits 78 indicating the address of the next first symbol Sm, and a data bit 76 indicating the data of the first symbol Sm, which is 1 in this example. The first symbol Sm includes predetermined address bits 78 "END" indicating the last first symbol, since there are no more first symbol in the packet P1, and a predetermined data bit 76 "X" in this example.

According to embodiments, the header H includes address bits 74 indicating the address of the closest first symbol Sj, and a data bit 72 indicating the data of the first symbol Sj, which is 0 in this example.

According to embodiments, the second symbols, i.e., symbols other than Sj, Sk and Sm, include only data bits, unlike the first symbols Sj, Sk and Sm. The second symbols do not have the address bits 78 that the first symbols Sj, Sk and Sm have.

According to embodiments, the packet P2 includes a first symbol Sp and second symbols other than the first symbol Sp.

Similar to the packet P1, the first symbols Sp include a data bit 76 and address bits 78. Since there is only one first symbol Sp in the packet P2, the first symbol Sp include predetermined address bits 78 "END" that indicate the last first symbol in the packet P2, and a predetermined data bit 76 "X" indicating the end of the first symbol in the packet P2.

According to embodiments, the header H in the packet P2 includes address bits 74 that indicate the address of the closest first symbol Sp, and a data bit 72 indicating the data of the first symbol Sp, which is 1 in this example.

Similar to the packet P1, the second symbols, i.e., symbols other than Sp, include only data bits, unlike the first symbol Sp.

The structure of the data packet DP will be described in more detail below.

Referring back to FIG. 2, the controller 12 may control the operation of the data generator 14. Specifically, the controller 12 may control the data generator 14 so that the data generator 14 receives image data ID to generate a data packet DP, such one shown in FIG. 3.

The transmitters Tx1 to Tx3 may receive the data packet DP from the data generator 14 and transmit a clock-embedded data packet DP to an external device.

Figure 4:
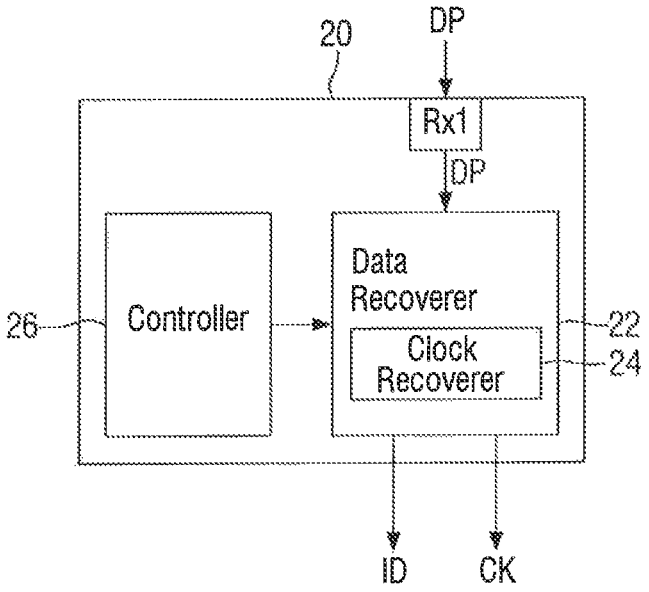
FIG. 4 is a block diagram that illustrates decoders shown in FIG. 1.

FIG. 4 is a block diagram that illustrates a decoder shown in FIG. 1.

Referring to FIG. 4, according to embodiments, each decoder 20 includes a data recoveror 22, a controller 26 and a receiver Rx1. It is to be understood that although FIG. 4 shows only one decoder 20 of the plurality of decoders, the other decoders have the same configuration.

According to embodiments, the receiver Rx1 receives the clock-embedded data packet DP from an external device, and provides it to the data recoveror 22.

According to embodiments, the data recoveror 22 receives the clock-embedded data packet DP, and recovers the image data ID. In some embodiments of the present disclosure, the data recoveror 22 includes a clock recoveror 24 that recovers a clock signal CK from the clock-embedded data packet DP.

In some embodiments, the data recoveror 22 performs an error handling function. Specifically, the data recoveror 22 performs the error handling function if there is an error in the address information of the received data packet DP. Detailed descriptions on this will be given below.

According to embodiments, the controller 26 controls the operation of the data recoveror 22.

Hereinafter, an operation of a display device according to some exemplary embodiments of the present disclosure will be described in more detail with reference to FIGS. 2 and 4 to 6.

Figure 5:
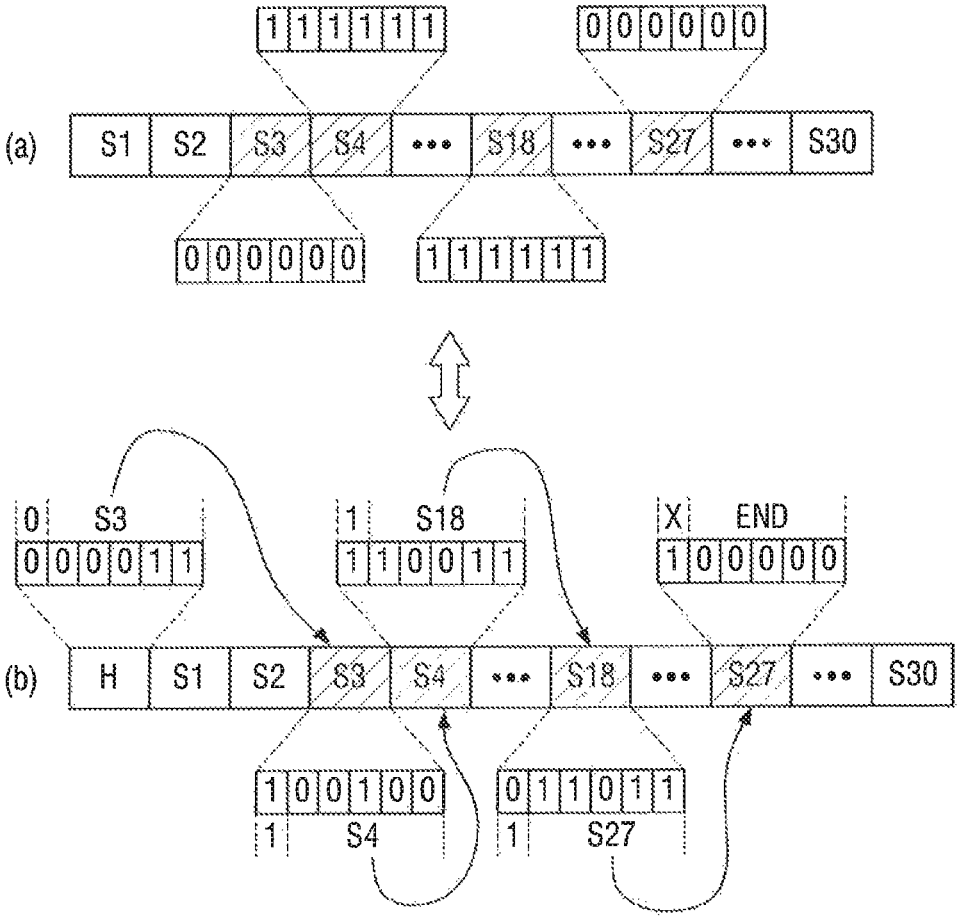
FIGS. 5 and 6 illustrate operation of a display device according to some exemplary embodiments of the present disclosure.
Figure 6:
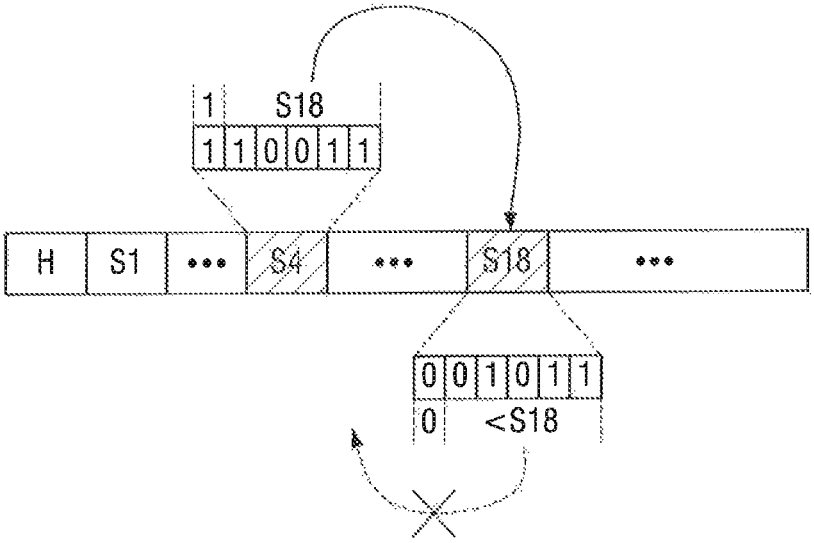

FIGS. 5 and 6 illustrate an operation of a display device according to some exemplary embodiments of the present disclosure.

In the following description, it is assumed that a symbol has six bits, i.e., n=6, for convenience of illustration.

First, FIG. 5(*a*) shows an example of image data ID provided to the data generator 14. Since a symbol has six bits, i.e., n=6, the data generator 14 divides the image data ID into packets of thirty ($=2^5-2$) symbols each.

According to embodiments, once the size of a single packet has been determined, the data generator 14 searches the symbols in the packet for symbols whose bits are all the same, and defines them as first symbols and the other symbols as second symbols. Specifically, the data generator 14 searches the symbols in a packet for symbols whose bits are all 1 s or 0 s to define them as the first symbols and defines the other symbols as the second symbols.

In the example shown in FIG. 5A, the bits of the symbols S3 and S27 are all 0 s, and the bits of the symbols S4 and S18 are all 1 s. Accordingly, the data generator 14 defines the symbols S3, S4, S18 and S27 as the first symbols, and defines symbols other than S3, S4, S18 and S27 as the second symbols. By this definition, every second symbol has at least one bit different from the others and is thus not involved in reducing the maximum run length. In other words, since each of the second symbols includes at least one bit of 0 or 1, they are not used in calculating the maximum run length.

Subsequently, the data generator 14 adds a header H to the beginning of the packet as shown in FIG. 5B to generate a data packet DP from the image data ID shown in FIG. 5A. The header H includes a data bit "0" indicative of the data of the closest first symbol, and address bits "00011" indicative of the address of the symbol S3.

In addition, according to embodiments, the data generator 14 reconfigures the first symbols S3, S4, S18 and S27 so that they each have a data bit and address bits, as shown in FIG. 5B. Specifically, the symbol S3 includes a data bit "1" indicative of the data of the symbol S4, and address bits "00100" indicative of the address of the symbol S4. The symbol S4 includes a data bit "1" indicative of the data of the symbol S18, and address bits "10011" indicative of the address of the symbol S18. The symbol S8 includes a data bit "0" indicative of the data of the symbol S27, and address bits "11011" indicative of the address of the symbol S27.

The first symbol S27 is located at the end of the packet shown in FIG. 5B. Accordingly, the symbol S27 has no subsequent first symbol to indicate in the packet. Accordingly, predetermined bits are stored in the data bit and the address bits of the symbol S27. In this example, the symbol S27 has the data bit "1" and the address bits "00000." In some embodiments of the present disclosure, the symbol S27 has different data bit and address bits. For example, the symbol S27 may have the data bit "0" and the address bits "11111."

According to embodiments, the transformed data packet DP as shown in FIG. SB is provided to each decoder 20 via the respective transmitters Tx1 to Tx3.

According to embodiments, the data recoveror 22. of the decoder 20 performs a reverse of the above-described processes to recover the image data ID.

Specifically, according to embodiments, the data recoveror 22 receives the data packet DP shown in FIG. 5B to transform the data of the first symbols S3, S4, S18 and S27, thereby recovering the image data ID shown in FIG. 5A.

Specifically, the data recoveror 22 transform the bits of the symbol S3 indicated by address bits "00011" of the header H into all 0 s, the bits of the symbol S4 indicated by address bits "00100" of the symbol S3 into all 1 s, the bits of the symbol S18 indicated by address bits "10011" of the symbol S4 into all 1 s, and the bits of the symbol S27 indicated by address bits "11011" of the symbol S18 into all 0 s. After the transformation is completed, the image data ID is obtained, such as that shown in FIG. 5A.

As described above, according to an exemplary embodiment of the present disclosure, the data packet DP includes $2^{(n-1)}-2$ symbols when each symbol includes n bits. Accordingly, address bits that include only 0 s only or address bits that include only 1 s cannot be stored.

For example, let us assume that a packet includes thirty symbols S1 to S30 as in the exemplary embodiment, i.e., n=6.

In addition, let us assume that the symbol S1 includes bits of all 0 s, and the symbol S30 includes bits of all 1 s in the image data ID shown in FIG. 5A.

When such symbols are transformed by the data generator 14 into those shown in FIG. 5B, the header H includes bits "000001." That is, the header H does not comprise bits "000000." In addition, the symbol indicating the symbol S30 includes bits "111110." That is, the symbol indicating the symbol S30 does not include bits "111111."

Accordingly, when the image data ID has been transformed into the data packet DP shown in FIG. 5B, there is no symbol that includes bits of all 0 s or all 1 s. That is, even the first symbols (S3, 54, S18 and 527) that include bits having the same value will have at least one different bit value in each of the symbols.

As a result, by using a data packet DP according to exemplary embodiments of the present disclosure, a maximum run length can be reduced without inserting an additional toggle bit into the packet. As the maximum run length is reduced, reliability of clock recovery can be improved.

Moreover, since no additional toggle bit is inserted, data processing overhead can also be reduced.

Now, an error handling operation by the data recoveror 22 will be described with reference to FIG. 6.

According to the exemplary embodiment of the present disclosure, the data recoveror 22 performs an error handling operation if the address bits of a succeeding first symbol is less than the address bits of a preceding first symbol.

Specifically, referring to FIG. 6, the symbol S18 indicates a first symbol succeeding symbol S4, and thus normally the address bits of the symbol S18 cannot be less than the address bits of the symbol S4. However, in FIG. 6, the address bits of the succeeding first symbol S18, i.e., "01011" is less than the address bits of the preceding first symbol S4, i.e., "10011." This means that there is an error in the address bits.

Accordingly, according to embodiments, when this happens, the data recoveror 22 no longer treats the address bits of the symbol S18 as address information but rather as data bits. That is, the data recoveror 22 recovers the bits of the symbol S18 as "001011" not "111111" when it recovers the image data ID from the data packet shown in FIG. 6.

If there is another succeeding first symbol after the symbol S18 in the packet, the succeeding first symbol can no longer be used as address information but can be recovered as data bits.

Figure 7:
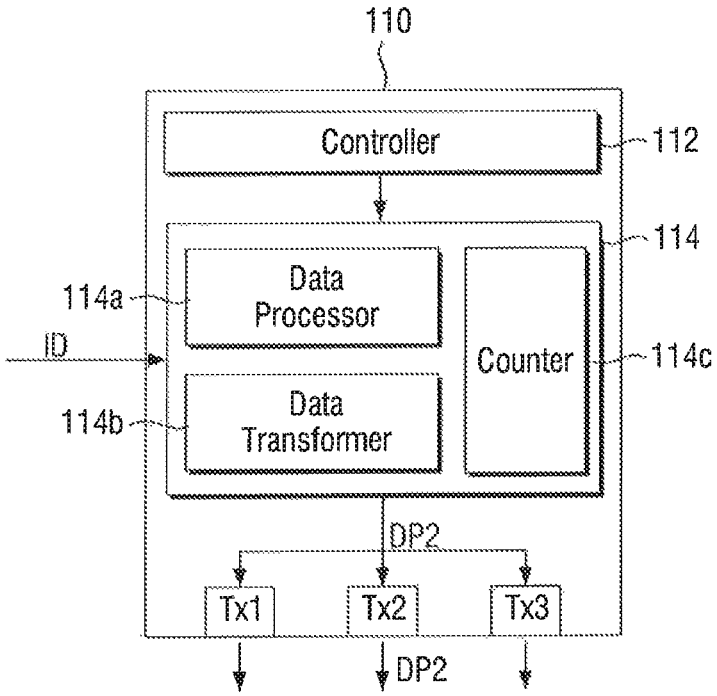
FIG. 7 is a block diagram that illustrates an encoder of a display device according to some other exemplary embodiments of the present disclosure.
Figure 8:
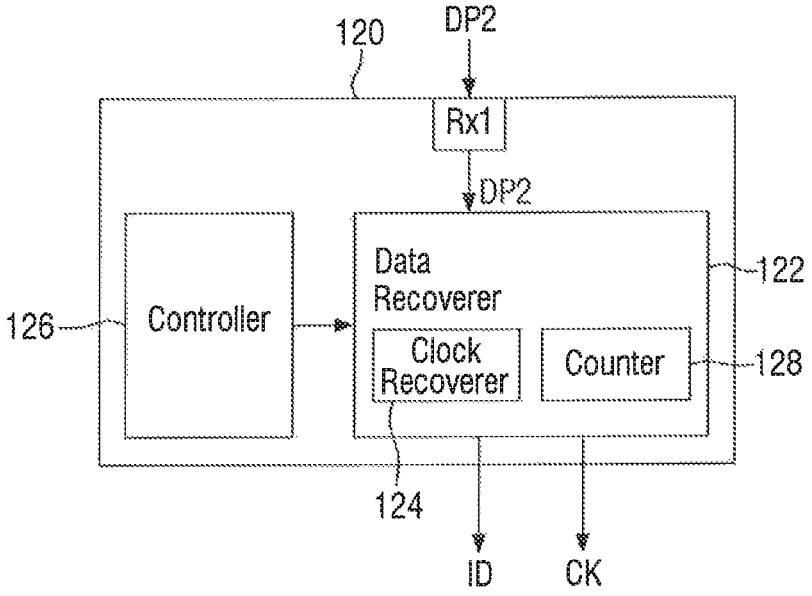
FIG. 8 is a block diagram that illustrates a decoder of a display device according to some other exemplary embodiments of the present disclosure.
Figure 9:
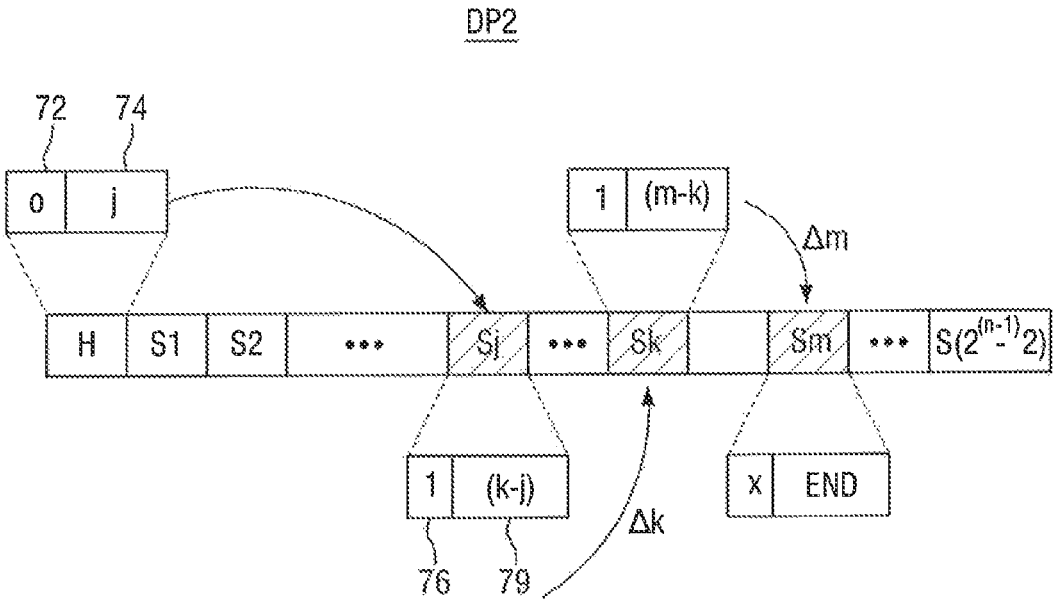
FIG. 9 illustrates a data packet output by an encoder shown in FIG. 7.

FIG. 7 is a block diagram that illustrates an encoder of a display device according to some other exemplary embodiments of the present disclosure. FIG. 8 is a block diagram that illustrates a decoder of a display device according to some other exemplary embodiments of the present disclosure. FIG. 9 illustrates a data packet output by the encoder shown in FIG. 7.

The following descriptions will focus on differences from the above exemplary embodiments.

Referring to FIG. 7, according to embodiments, the encoder 110 includes a controller 112, a data generator 114, and transmitters Tx1 to Tx3. The functionalities of the controller 112 and the transmitters Tx1 to Tx3 are identical to those described above, and, therefore, a repeated description thereof will be omitted.

According to embodiments, the data generator 114 includes a data processor 114*a*, a data transformer 114*b*, and a counter 114*c*.

According to embodiments, the data processor 114*a* receives image data ID to perform clock signal embedding. The data transformer 114*b* transforms the image data ID into a data packet DP2 and outputs it to the transmitters Tx1 to Tx3. The counter 114*c* counts the number of symbols between the first symbols.

Specifically, according to embodiments, the counter 114*c* counts the number of second symbols between the first symbols. The first symbols in the data packet DP2 output by the data generator 114 include the count value from the counter 114*c* as address information.

In an above exemplary embodiment described with reference to FIG. 3, the address information included in the first symbols Sj, Sk, Sm and Sp is an absolute address with respect to the first symbols. In contrast, according to an exemplary embodiment, the address information included in the first symbols Sj, Sk and Sm is a relative address with respect to succeeding first symbols.

For example, according to embodiments, in an above exemplary embodiment described with reference to FIG. 3, the address of a first symbol is indicated with an absolute address, such as an index included in the preceding first symbol. In contrast, according to an exemplary embodiment, the address of a first symbol is indicated by a relative address such as a distance to the next first symbol. However, embodiments are not limited thereto, and the header H may indicate the address of the next first symbol with an absolute address.

Specifically, referring to FIG. 9. in the data packet DP2 according to an exemplary embodiment, the header H includes a data bit 72 indicating the data of the next first symbol Sj, 0 in this example, and address bits 74 indicating the address of the next first symbol Sj.

According to embodiments, the symbol Sj includes a data bit 76 indicating the data of the next first symbol Sk, 1 in this example, and address bits 79 indicating the distance to the next first symbol Sk, k-j, i.e., the number of second symbols between the symbol Sk and the symbol Sj. The symbol Sk includes a data bit 76 indicating the data of the next first symbol Sm, 1 in this example, and address bits 79 indicating the distance to the next first symbol Sm, m-k, i.e., the number of second symbols between the symbol Sm and the symbol Sk. The first symbol Sm includes a predetermined data bit 76 "X" indicating the end of the first symbol, and predetermined address bits 76 "END" indicating the last first symbol.

Referring to FIG. 8, according to embodiments, the decoder 120 includes a controller 126, a data recoveror 122, and a receiver Rx1. The functionalities of the controller 126 and the receiver Rx1 are identical to those described above; and, therefore, a repeated description thereof will be omitted.

According to embodiments, the data recoveror 122 receives the clock-embedded data packet DP2, and recovers the image data ID. In some embodiments of the present disclosure, the data recoveror 122 includes a clock recoveror 124 that recovers a clock signal CK from the clock embedded data packet DP2, and a counter 128 that counts the number of the symbols between the first symbols in the packet. Specifically, according to embodiments, the counter 128 counts the number of second symbols between the first symbols.

In some embodiments of the present disclosure, the counter 128 is eliminated if the decoder 120 does not require one.

According to embodiments, the data recoveror 122 receives the data packet DP2 such as one shown in FIG. 9, and recovers the image data ID using the address information included in the header H and the first symbols Sj, Sk and Sm. The operation of the data recoveror 122 will be clear to those skilled in the art based on the foregoing description, and therefore, a repeated description thereof will be omitted.

Figure 10:
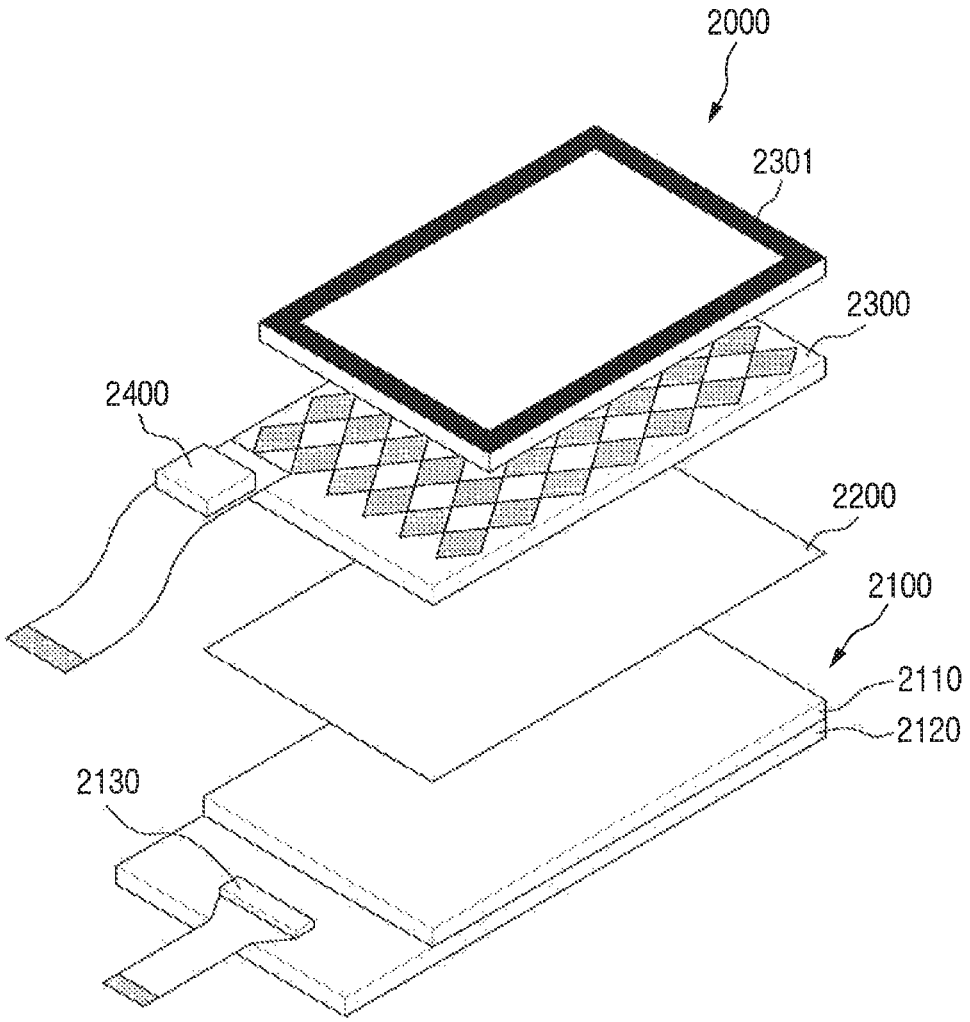
FIG. 10 shows a display module according to some exemplary embodiments of the present disclosure.

FIG. 10 shows a display module according to some exemplary embodiments of the present disclosure.

Referring to FIG. 10, the display module 2000 includes a display device 2100, a polarizing plate 2200, and a window glass 2301. The display device 2100 includes a display panel 2110, a printed circuit board (PCB) 2120, and a display driving chip 2130.

According to embodiments, the window glass 2301 is typically formed of a material such as acryl or tempered glass, and protects the display module 2000 from external impact or scratches due to repeated touches. The polarizing plate 2200 improves optical characteristics of the display panel 2110. The display panel 2110 is formed by patterning a transparent electrode on the PCB 2120. The display panel 2110 includes a plurality of pixel cells for displaying an image. According to an exemplary embodiment of the present disclosure, the display panel 2110 may be an organic light-emitting diode panel. Each of the pixel cells includes an organic light-emitting diode that emits light in proportion to the magnitude of electric current applied thereto. However, this is illustrative, and embodiments are not limited thereto. The display panel 2110 may include a variety of display elements. For example, the display panel 2110 may a liquid-crystal display (LCD), an electrochromic display (ECD), a digital mirror device (DMD), an actuated mirror device (AMD), a grating light value (GLV), a plasma display panel (PDP), an electro luminescent display (ELD), a light-emitting diode (LED) display, or a vacuum fluorescent display (VFD).

According to embodiments, the display driving chip 2130 includes a display driving circuit described above, such as the decoder 20 of FIG. 1. Although the display driving chip 2130 is shown as a single chip in this exemplary embodiment, this is illustrative, and embodiments are not limited thereto. A plurality of driving chips may be mounted as the display driving chip. In addition, the display driving chip 2130 can be mounted on the PCB 2120 made of glass in the form of chip-on-glass (COG). However, this is illustrative, and embodiments are not limited thereto. The display driving chip 2130 may also be mounted on the PCB 2130 in the form of chip-on-film (COF), chip-on-board (COB), etc.

According to embodiments, the display module 2000 further includes a touch panel 2300 and a touch controller 2400. The touch panel 2300 can be formed by patterning a transparent electrode such as indium tin oxide (ITO) on a glass substrate or a polyethylene terephthalate (PET) film. The touch controller 2400 senses a touch on the touch panel 2300, calculates the coordinates of the touch, and transmits the calculated coordinates to a host. The touch controller 2400 can be integrated with the display driving chip 2130 as a single semiconductor chip.

Figure 11:
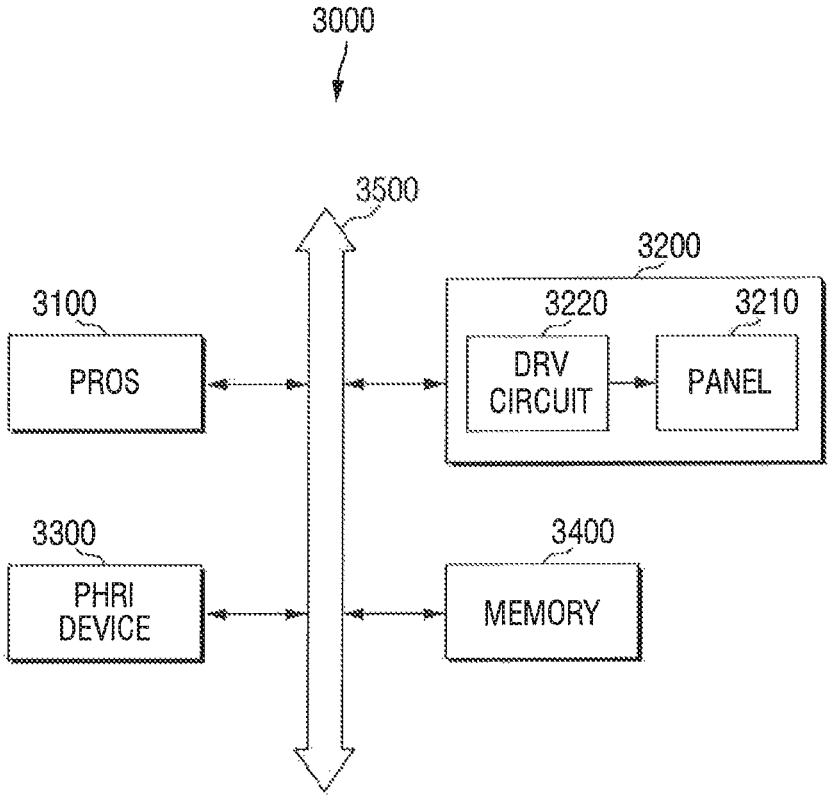
FIG. 11 shows a display system according to some exemplary embodiments of the present disclosure.

FIG. 11 shows a display system according to some exemplary embodiments of the present disclosure.

Referring to FIG. 11, a display system 3000 includes a processor 3100 electrically connected to a system bus 3500, a display device 3200, a peripheral device 3300, and a memory 3400.

According to embodiments, the processor 3100 controls data input/output to/from the peripheral device 3300, the memory 3400 and the display device 3200, and processes image data transmitted between the devices.

According to embodiments, the display device 3200 includes a panel 3210 and a driving circuit 3220, and stores image data items received via the system bus 3500 in a frame memory in the driving circuit 3220 to display them on the panel 3210. The display device 3200 may be, for example, the display device shown in FIG. 1. By, incorporating the driving circuit 3220, the display device 3200 can operate asynchronously with the processor 3100, which can reduce the burden on the processor 3110.

According to embodiments, the peripheral device 330 can be a device that converts videos or still images into electrical signals, such as a camera, a scanner, webcam, etc. The image data obtained by the peripheral device 330 can be stored in the memory 3400 or can be displayed on the panel of the display device 3200 in real-time.

The memory 3400 may include a volatile memory such as a DRAM and/or a non-volatile memory such as a flash memory. The memory 3400 may include DRAM, PRAM, MRAM, ReRAM, FRAM, NOR flash memory, NAND flash memory, and a fusion flash memory, such as a combination of an SRAM buffer, a NAND flash memory and a NOR interface logic, etc. The memory 3400 can store image data obtained from the peripheral device 3300 therein or image signal processed by the processor 3100.

The display system 3000 according to exemplary embodiments of the present disclosure can be incorporated into a mobile electronic device such as a smart phone. However, this is illustrative, and embodiments are not limited thereto. The display system 3000 can be incorporated in a variety of types of electronic devices that can display image.

Figure 12:
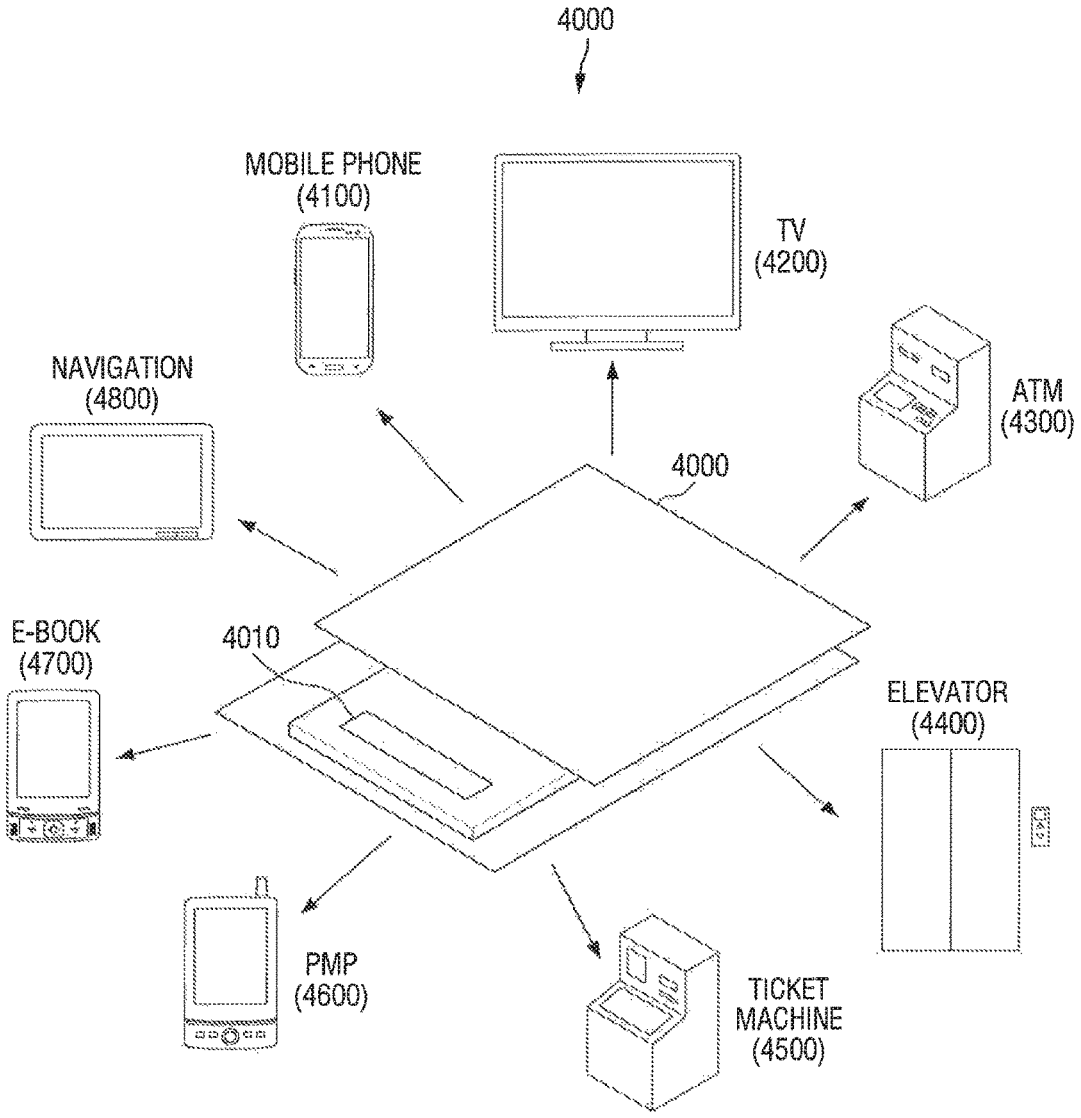
FIG. 12 shows a variety of electronic devices in which a display device according to some exemplary embodiments of the present disclosure may be incorporated.

FIG. 12 shows variety of electronic devices in which a display device according to some exemplary embodiments of the present disclosure can be incorporated.

The display device 4000 according to some exemplary embodiments of the present disclosure can be used by a variety of electronic devices. In addition to a mobile phone 4100, the display device 4000 can find applications in a TV 4200, an automated teller machine (ATM) 4300, an elevator 4400, a ticket machine 4500, a portable media player (PMP) 4600, an e-book 470, a navigation device 4800, etc.

According to some exemplary embodiment of the present disclosure, the display device 4000 can operate asynchronously with the processor of the system. Accordingly, the burden on the processor can be reduced, such that the processor can operate at high speed with low voltage to improve the performance of the electronic device.

While embodiments of the present inventive concept have been particularly shown and described with reference to exemplary embodiments thereof, it will be understood by those of ordinary skill in the art that various changes in form and details may be made therein without departing from the spirit and scope of the present inventive concept as defined by the following claims. It is therefore desired that the present embodiments be considered in all respects as illustrative and not restrictive, reference being made to the appended claims rather than the foregoing description to indicate the scope of embodiments of the inventive concept.

What is claimed is:

1. A display device comprising:

a data generator configured to generate a clock-embedded data packet;

a data recoveror configured to receive the clock-embedded data packet to recover data therefrom; and a controller configured to control operation of the data generator and configured to control operation of the data recoveror, wherein the data packet comprises a header, a first symbol that includes address information therein, and a second symbol that does not include address information, wherein the header comprises address information of the first symbol, and wherein the data recoveror uses address information in the header to recover data of the first symbol.

2. The display device of claim 1, wherein the first symbol comprises address bits indicative of address information of a subsequent first symbol, and a data bit indicative of data associated with the subsequent first symbol.

3. The display device of claim 2, wherein a first symbol that is a last first symbol comprises a predetermined data bit, and predetermined address bits indicative of the last first symbol.

4. The display device of claim 1, wherein the data packet comprises $2^{(n-1)}-2$ symbols, and each of the symbols comprises n-bit data, wherein n is a natural number that is greater than or equal to 3.

5. The display device of claim 1, wherein the data generator comprises:

a data processor configured to receive image data and to embed a clock signal therein; and a data transformer configured to transform at least a part of the image data into the first symbol to generate the data packet.

6. The display device of claim 5, wherein the data transformer is configured to transform a symbol whose bits all have a same value into the first symbol.

7. The display device of claim 1, wherein the address information of the first symbol comprises an absolute address of a subsequent first symbol.

8. The display device of claim 5, wherein data generator further comprises a counter configured to count a distance between successive first symbols, wherein the address information of the first symbol comprises the distance between the first symbol and the subsequent first symbol.

9. The display device of claim 1, wherein the address information of the header comprises an absolute address of the first symbol.

10. A display device comprising:

a data recoveror configured to receive a clock-embedded data packet to recover data therefrom; and a controller configured to control operation of the data recoveror, wherein the data packet comprises, a first symbol that includes address information therein, a second symbol that does not include address information, and a header that includes address information of the first symbol, wherein the first symbol comprises a data bit and address bits indicative of address information of a subsequent first symbol, and the header comprises address bits of the first symbol, and wherein the data recoveror uses the address information in the header to recover data of the first symbol.

11. The display device of claim 10, wherein the data recoveror comprises a clock recoveror configured to recover a clock signal from the clock-embedded data packet.

12. The display device of claim 11, wherein the data recoveror further comprises a counter configured to count a distance between successive first symbols, wherein the address information of the first symbol comprises the distance between the first symbol and the subsequent first symbol.

13. The display device of claim 10, wherein the data recoveror is configured to recover the address bits of a subsequent first symbol as data bits if the address bits of subsequent first symbol are less than the address bits of the first symbol, and the data recoveror is configured to recover the address bits of the subsequent first symbol if an address of the subsequent first symbol is equal to the address bits of the first symbol.

14. The display device of claim 10, wherein the data recoveror is configured to recover data of the subsequent first symbol from the data bits of the first symbol.

15. A display device comprising:

a data generator configured to generate a clock-embedded data packet; and a data recoveror configured to receive the clock-embedded data packet to recover data therefrom, wherein the data packet comprises a first symbol that includes address information therein, a second symbol that does not include address information, and a header that includes address information of the first symbol, wherein the data packet comprises $2^{(n-1)}-2$ symbols, and each of the symbols comprises n-bit data, wherein n is a natural number that is greater than or equal to 3.

16. The display device of claim 15, wherein the first symbol comprises address bits indicative of address information of a subsequent first symbol, and a data bit indicative of data associated with the subsequent first symbol, wherein the data generator transforms a symbol whose bits all have a same value into the first symbol.

17. The display device of claim 16, wherein the data recoveror is configured to recover the address bits of the subsequent first symbol if an address of the subsequent first symbol is equal to the address bits of the first symbol, and to recover data of the subsequent first symbol from the data bits of the first symbol, and the data recoveror is configured to recover the address bits of a subsequent first symbol as data bits if the address bits of subsequent first symbol are less than the address bits of the first symbol.

18. The display device of claim 16, further comprising:

a recoveror controller configured to control operation of the data recoveror;

a generator controller configured to control operation of the data generator; and a clock recoveror configured to recover a clock signal from the clock-embedded data packet.

* * * * *